US007448190B2

(12) United States Patent
Gomez

(10) Patent No.: US 7,448,190 B2
(45) Date of Patent: Nov. 11, 2008

(54) MACHINE FOR SEALED COVER FOR A SET OF DOCUMENTS

(75) Inventor: Angel Gomez, Alissas (FR)

(73) Assignee: SECAP (Groupe Pitney Bowes), S.A.S., La Plaine St Denis (FR)

( * ) Notice: Subject to any disclaimer, the term of this patent is extended or adjusted under 35 U.S.C. 154(b) by 837 days.

(21) Appl. No.: 10/398,020

(22) PCT Filed: Sep. 28, 2001

(86) PCT No.: PCT/FR01/03018

§ 371 (c)(1),
(2), (4) Date: Aug. 6, 2003

(87) PCT Pub. No.: WO02/26508

PCT Pub. Date: Apr. 4, 2002

(65) Prior Publication Data

US 2005/0034433 A1 Feb. 17, 2005

(30) Foreign Application Priority Data

Sep. 29, 2000 (FR) ..... 00 12479

(51) Int. Cl.
*B65B 43/26* (2006.01)

(52) U.S. Cl. ..... 53/569; 53/284.3; 53/381.5

(58) Field of Classification Search ..... 53/255, 53/258, 284.3, 381.5, 381.6, 389.1, 564, 53/569

See application file for complete search history.

(56) References Cited

U.S. PATENT DOCUMENTS 4,169,341 A * 10/1979 Roetter et al. ..... 53/154
5,255,498 A * 10/1993 Hotchkiss et al. ..... 53/569
5,467,577 A * 11/1995 Sato ..... 53/468
5,924,265 A * 7/1999 Auerbach ..... 53/460
6,164,046 A * 12/2000 Werner et al. ..... 53/569
6,289,658 B1 * 9/2001 Sting et al. ..... 53/569
6,494,019 B1 * 12/2002 Lingle ..... 53/247
6,536,184 B1 * 3/2003 Sting et al. ..... 53/284.3
6,751,929 B1 * 6/2004 Sting et al. ..... 53/252
6,996,959 B2 * 2/2006 Sting ..... 53/569

FOREIGN PATENT DOCUMENTS

| | | |
|---|---|---|
| DE | 199 13 637 C1 | 9/2000 |
| EP | 0 596 511 A1 | 5/1994 |
| WO | 99/01295 | 1/1999 |

* cited by examiner

*Primary Examiner*—Thanh K Truong
(74) *Attorney, Agent, or Firm*—George M. Macdonald; Angelo N. Chaclas

(57) ABSTRACT

The invention concerns a machine for providing a sealed cover for documents comprising a document conveying table (18) with a general longitudinal shape, arranged upstream of a unit for inserting (20) said documents in an envelope (26), at least a contact member (40, 42) mobile longitudinally, under the action of driving means (76, 82, 84, 88) in the direction of the inserting unit and which is designed to drive the documents on the conveying table, the driving means being distant from the inserting unit. The invention is characterized in that said at least one contact member is arranged on a mobile support (44) linked to the driving means in a zone (44*b*) located upstream of said at least one contact member, the driving means imposing on said at least one contact member is reciprocating translational movement between two extreme positions, in one of said extreme positions said at least one contact member being placed proximate to the inserting unit.

8 Claims, 4 Drawing Sheets

MACHINE FOR SEALED COVER FOR A SET OF DOCUMENTS

BACKGROUND

The invention relates to a machine for inserting documents into an envelope, the machine including a generally elongate document routing table on the upstream side of an insertion unit for inserting said documents into an envelope, and at least one contact member that can be moved longitudinally by drive means remote from the insertion unit toward the insertion unit and is adapted to push the documents on the routing table.

In prior art machines of the above type for inserting documents into envelopes an envelope held open by a plurality of suckers disposed above it is disposed on the insertion unit, aligned with the routing table, in order to receive documents coming from the table.

The side of the envelope with the flap is placed on a table forming part of the insertion unit, with the flap directed downward and disposed under the routing table, and the other side of the envelope, with no flap, is placed above the first face and clings to the suckers so that the envelope can be opened.

SUMMARY

The Applicant has addressed the problem of inserting documents into an envelope and has found that, in some cases, the routing table can receive a stack of documents which, in the case of A4 sheets of paper, can be up to 8 mm thick.

The Applicant has also addressed the problem of inserting into an envelope documents having different formats.

With documents having different formats, the contact member(s) connected to the drive means must be able to push the documents to the far end of the envelope, and because of the relatively large volume and/or the varied formats of the documents, the flap of the envelope must be held as close as possible to the plane containing the side of the envelope to which the flap is attached.

To do this, the drive means are spaced from the insertion unit in order to form between them a space adapted to receive a solenoid, for example, whose function is to hold the flap as much as possible against the lower portion of the routing table.

The Applicant has developed an envelope filling machine of relatively simple design that allows for at least some of the constraints imposed by inserting into an envelope a relatively thick set of documents, possibly with varied formats.

The present invention therefore provides a machine for inserting documents into an envelope, the machine including a generally elongate document routing table on the upstream side of an insertion unit for inserting said documents into an envelope, and at least one contact member that can be moved longitudinally by drive means remote from the insertion unit toward the insertion unit and is adapted to push the documents on the routing table, which machine is characterized in that said at least one contact member is on a mobile support connected to the drive means in an area upstream of said at least one contact member and the drive means imposing on said at least one contact member and on the support a reciprocating movement in translation between two extreme positions in one of which said at least one contact member is in the vicinity of the insertion unit.

Thus the contact member(s) on a mobile support connected to the drive means are offset from those means and therefore have sufficient extension in the longitudinal direction to be placed in the vicinity of the insertion unit and thus to be able to push the documents on the routing table to the far end of the envelope.

Also, because the combination of the contact member(s) and the support reciprocates in longitudinal translation, it can be moved back to a so-called initial position once the documents are inserted into the envelope, without damaging the envelope, unlike a solution with one or more stops on a longitudinal belt running around two shafts parallel to the routing table and perpendicular to the longitudinal direction in which the documents are fed.

In that kind of solution, the stop(s) would have to be sufficiently high to be able to push the documents to the far end of the envelope and would tear the envelope on beginning their downward movement to complete their travel by returning to the initial position.

To provide an envelope filling machine capable of pushing a relatively thick and therefore heavy set of documents and of resisting the forces that are generated in the event of a document jam on the routing table without damaging the machine, the drive means advantageously include an endless loop longitudinal transport member rotatably mounted around two parallel shafts perpendicular to the longitudinal direction of the table and contained in a plane P under and parallel to the routing table and the support is connected to said drive means by a mechanism which reduces the mechanical forces exerted on the transport member by distributing those forces, in particular in the mechanism itself.

Thus the longitudinal transport member (for example a belt) cannot be damaged by shear forces, as would be the case if there were high stops on the belt.

When a thick set of documents is to be pushed, or if a document jam occurs on the routing table, the maximum forces are transmitted to the base of the stop(s), where they are mounted on the belt.

These forces cause shearing at this point and this would require relatively major maintenance operations, since it would be necessary to remove and replace the entire belt.

Note that the machine according to the invention is particularly advantageous in that documents are pushed at a constant speed.

This is very important because, if documents are stacked and the speed of the contact member(s) is not constant, the documents tend to slide relative to each other and this impedes their insertion into the envelope, with the possible risk of causing a document jam on the routing table.

According to one feature, the connecting mechanism converts rotation of the longitudinal transport member into longitudinal reciprocation in translation. This caters for prior art envelope filling machines, which frequently include a longitudinal transport member that rotates about two axes.

According to another feature, the connecting mechanism includes at least one pusher member perpendicular to the longitudinal direction of movement of the support for pushing the support and link means articulated about two link shafts that are parallel to the shafts of the transport member and one of which is fastened to the pusher member and disposed in the plane P and the other of which is fastened to the transport member.

According to one feature, the connecting mechanism includes means for holding the pusher member in a position perpendicular to the longitudinal direction of movement of the support.

This achieves better distribution of the forces exerted on the mechanism and prevents those forces being concentrated at the link shaft connecting the pusher member to the link means.

To be more specific, the holding means include two bearings mounted on the pusher member, offset relative to each other in the longitudinal direction and respectively cooperating with two parallel longitudinal grooves disposed one above the other. This advantageous arrangement guides the pusher member and keeps it vertical.

According to one feature, the pusher member has a reduced section area in an upper portion in which the maximum forces are exerted.

The pusher member is intentionally weakened, constituting a kind of "mechanical fuse" that can be broken by an excessive force.

Accordingly, in the event of a break in this area, maintenance personnel need only change the pusher member, instead of having to remove and replace the longitudinal transport member, as in the solution referred to above.

Alternatively, the portion of the mechanism forming a mechanical fuse can be the link means, which are intentionally weakened.

According to another feature, the machine includes guide means for guiding longitudinal movement in translation of the support, which facilitates that movement.

To be more specific, the guide means include bearings cooperating with longitudinal members, for example angle-irons.

BRIEF DESCRIPTION OF THE DRAWINGS

Other features and advantages will become apparent in the course of the following description, which is given by way of nonlimiting example and refers to the accompanying drawings, in which.

DETAILED DESCRIPTION

Figure 1:
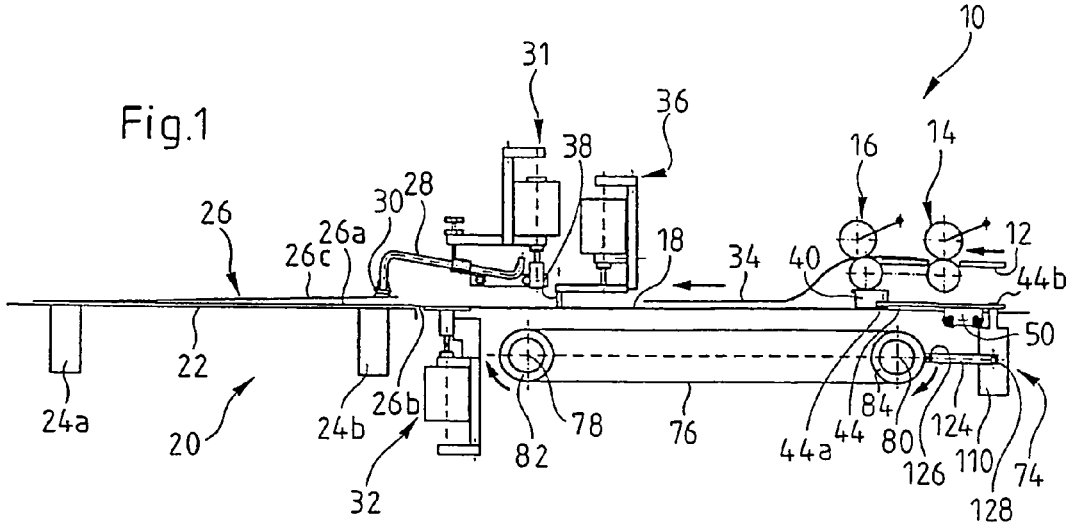
FIG. 1 is a diagrammatic view in longitudinal section of a machine in accordance with the invention for filling envelopes.

FIG. 1 is a partial diagrammatic view of a document processing machine, for example a machine for inserting documents into envelopes.

This kind of machine includes document dispensers, not shown, which dispense documents on a document feeder table 12.

The documents on the feeder table pass between two pairs of rollers 14 and 16 before they are deposited on a routing table 18.

The table 18 is of generally elongate shape in the direction in which documents on the table are routed, and extends from an end under the document feeder table 12 to an insertion unit 20 facing the opposite end of the table 18.

Broadly speaking, the insertion unit 20 takes the form of a table 22 on legs 24*a* and 24*b*.

As shown in FIG. 1, an envelope 26 coming from an envelope dispensing station known in the art, and not shown in the figures, is placed on the table 22 so that the side of the envelope 26*a* carrying the flap 26*b* is in contact with the table and the other side 26*c* with no flap is on top.

A sucker is provided at the end of each tube of a set of tubes, only one tube 28 and one sucker 30 being shown in the figure. The set of tubes is disposed above the routing table 18 and the table 22 so that the suckers can come into contact with the side 26*c* of the envelope and lift it, holding the envelope open and ready to receive documents. The upward and downward movements of the tubes are controlled in a manner that is known in the art by a solenoid 31.

As is also known in the art, another solenoid 32 is located under the routing table 18 in line with the area which contains the flap 26*b* of the envelope and is placed under this table.

When the solenoid is activated (FIGS. 1 and 5) its plunger presses the flap 26*b* of the envelope against the lower portion of the table 18 so that the flap is aligned with the side 26*a* of the envelope as much as possible.

This shapes the envelope so that its opening is as wide as possible and it can therefore receive as many documents as possible.

The documents 34 shown diagrammatically in FIG. 1 consist of A4 and A5 sheets and sheets one third of the A4 size, for example, and form on the routing table 18 a stack of documents up to 8 mm thick.

The mobile end of a solenoid 36 is provided with one or more stops 38 which serve as an abutment for stopping the documents 34 before they reach the insertion unit 20, if necessary.

In FIG. 1, the solenoid is activated and the stop 38 is positioned against the table 18.

Figure 5:
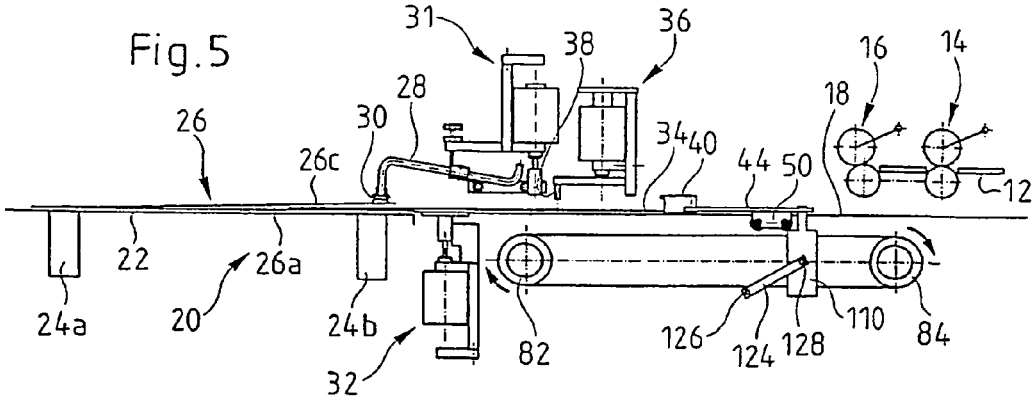
FIGS. 5 and 6 are views of the machine shown in FIG. 1 with the support carriage and the contact members in different positions.

When the solenoid is deactivated, the stop 38 is raised to allow the documents to pass, as shown in FIG. 5.

The envelope filling machine according to the invention includes at least one contact member adapted to push the documents 34 on the routing table 18 toward the envelope 26 on the table 22 of the insertion unit 20.

Figure 2:
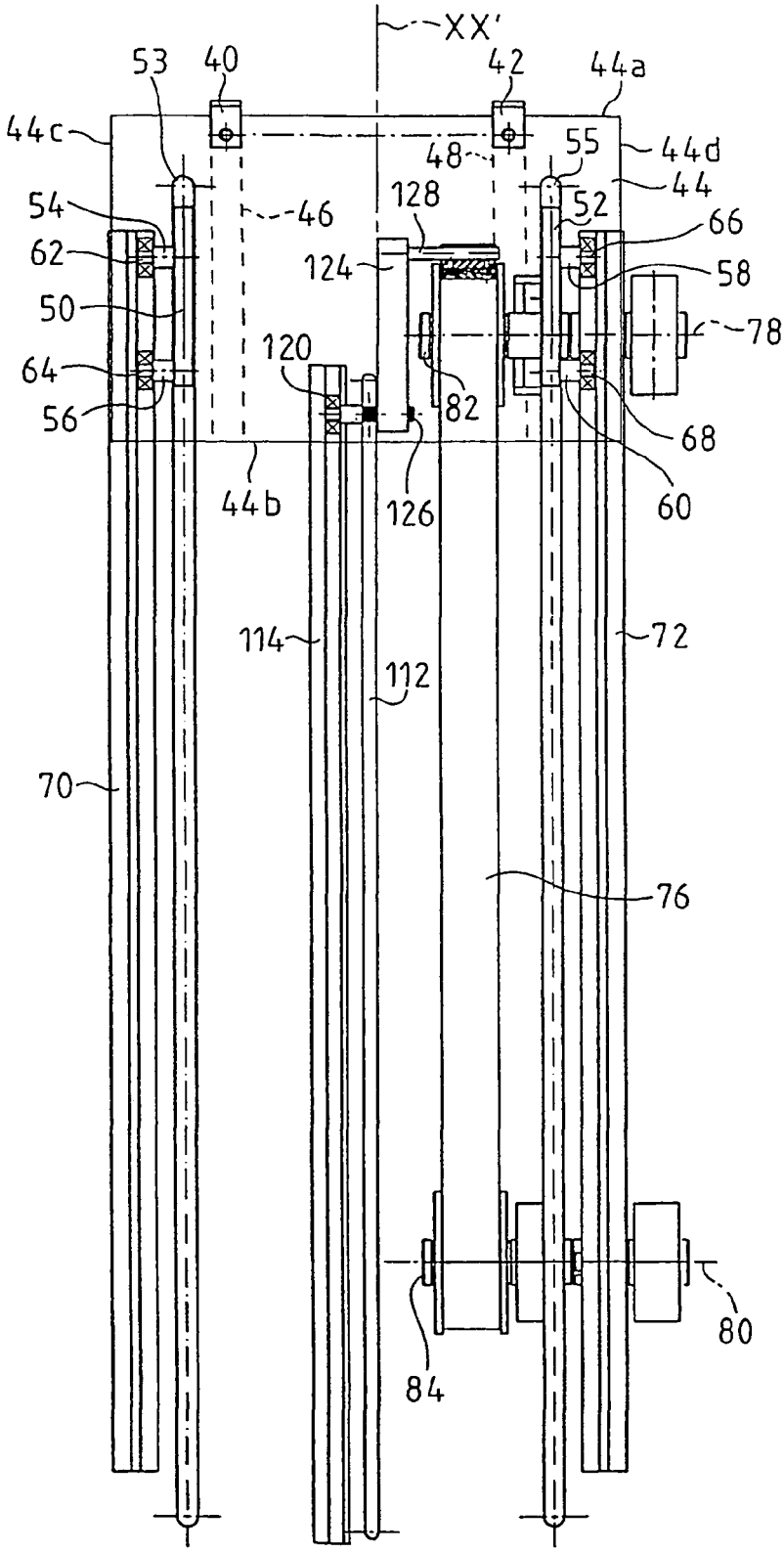
FIG. 2 is a diagrammatic plan view of the portion of the envelope filling machine shown in FIG. 1 containing contact members and a support in the form of a carriage.
Figure 3:
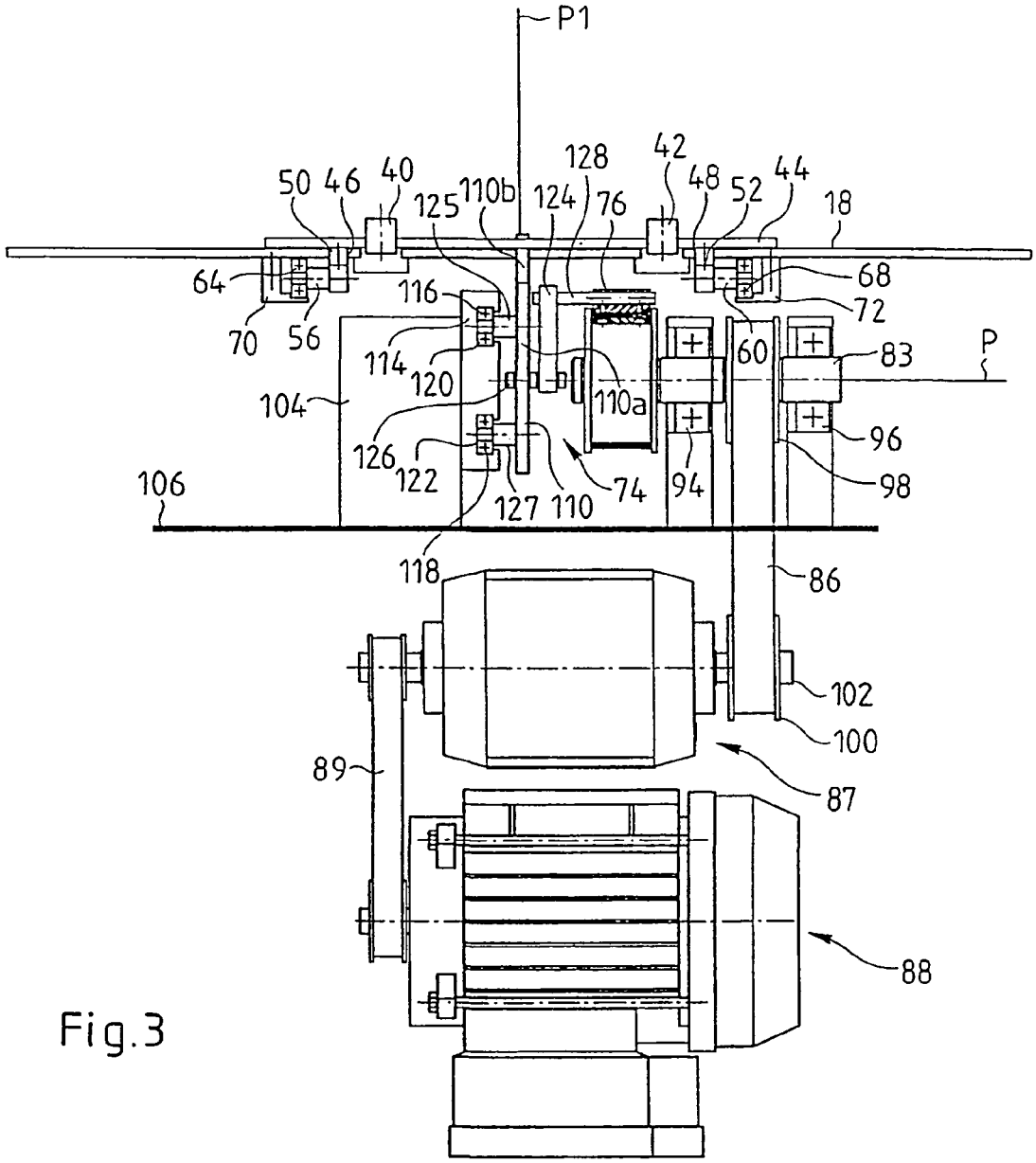
FIG. 3 is a diagrammatic view in cross section of the machine shown in FIG. 1.

To be more specific, and as shown in FIGS. 1 to 3, two contact members in the form of contact fingers 40 and 42 (FIG. 2) are fitted into notches at an end 44*a* of a support 44 in the form of a carriage.

This support takes the form of a plate over the routing table 18.

The support carriage is connected to drive means under the routing table 18, upstream of the solenoid 32, and therefore remote from the insertion unit 20.

Figure 6:
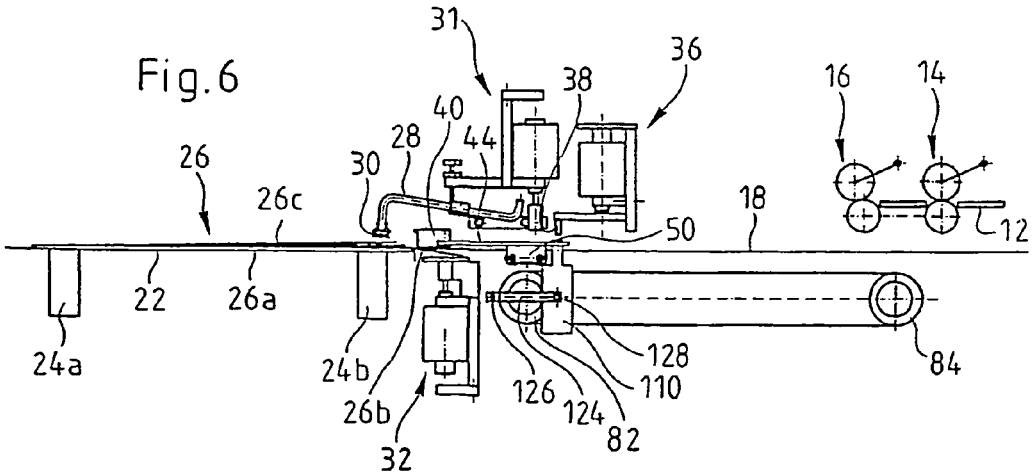

As shown diagrammatically in FIG. 2, the drive means, which are described later, move the support carriage equipped with the contact members 40 and 42 with a reciprocating movement in translation in the longitudinal direction of the routing table 18, between two extreme positions, one of which is a rest position shown in FIG. 1 and the other of which is shown in FIG. 6 and is described later.

In this latter extreme position, the contact members 40 and 42 are in the vicinity of the insertion unit 20.

The support carriage 44 and the contact members 40 and 42 are above the routing table 18 and during the reciprocating movement in translation of the combination of the support and the contact members, the contact members slide in two parallel longitudinal slots 46 and 48 in the table 18. The slots are shown partly and diagrammatically in FIG. 2.

A document routing table with slots like these is known in the art.

Note that, to prevent mechanical friction, the support 44 is not in contact with the table 18.

The envelope filling machine further includes means for guiding longitudinal movement in translation of the support carriage which also raise the support relative to the routing table 18.

The guide means include two parallel support members 50 and 52 under the support carriage and perpendicular to the surface thereof.

The support members 50 and 52 are symmetrical with respect to the median longitudinal axis XX' of the support 44 and the routing table 18.

As shown in FIGS. 2 and 3, the support members 50 and 52 slide in longitudinal slots 53 and 55 in the routing table 18 parallel to the longitudinal slots 46 and 48 shown in FIG. 2.

Each support member includes two parallel shafts parallel to the support carriage and facing outward.

The shafts 54 and 56 (respectively 58 and 60) of the support member 50 (respectively 52) are provided at their free ends with respective bearings 62 and 64 (respectively 66 and 68).

As shown in FIG. 3, parallel longitudinal guide members 70 and 72 in the form of angle-irons are provided under the routing table 18.

The angle-irons have a generally elongate shape and an L-shaped cross section.

The two angle-irons face each other so that the inside of the L-shape of one angle-iron faces the inside of the L-shape of the other angle-iron and the angle-irons can cooperate with the respective bearings 62, 64, 66 and 68 of the respective support members 50 and 52.

Locating the guide means as close as possible to the lateral edges 44*c* and 44*d* of the support carriage improves the guidance of the carriage when it moves in longitudinal translation on the table 18 and prevents transverse movements of the support.

Transverse movements could occur if the support carriage guide means were near the plane P 1 (FIG. 3).

It should be noted that if high forces are generated, for example if there is a document jam on the routing table 18, the guide means previously mentioned absorb some of the forces transmitted to the structure.

The mobile support carriage 44 is connected to the drive means by a connecting mechanism 74 in an area upstream of the contact members 40 and 42, to be more precise in the vicinity of the end 44*b* of the support.

As shown in FIGS. 1 to 3, the drive means include an endless loop longitudinal transport member 76 running around two parallel shafts 78 and 80 lying a plane P parallel to and under the routing table 18.

The shafts 78 and 80 are perpendicular to the longitudinal direction XX' of the routing table.

The longitudinal transport member takes the form of a notched belt, for example, cooperating with pulleys 82 and 84 rotating about respective shafts 78 and 80.

Note that the notched belt and pulleys can be replaced by a chain and sprocket system.

As shown in FIG. 3, rotation of the pulley 82 is driven by a shaft 83 and a belt 86 connected to a clutch 87 which is in turn connected to a motor 88 by a belt 89.

Two blocks 90 and 92 support the shaft 83 of the pulley 82 and the shaft of the pulley 84, which is not shown in the figures.

The shaft 83 of the pulley 82 passes through the blocks 90 and 92, which are provided with respective bearings 94 and 96. The blocks 90 and 92 lie one on each side of a pulley 98 on which the belt 86 is mounted; the belt is also mounted on another pulley 100 on an output shaft 102 of the clutch 87.

The pulley 84 is an idler pulley and is not described further.

The connecting mechanism 74 converts rotation of the belt 76 into a reciprocating movement in longitudinal translation. The mechanism is supported by a frame 104 on a plinth 106 on which the blocks 90 and 92 are also disposed.

The mechanism 74 providing the mechanical connection between the drive means 76, 82, 84 and 88 and the support carriage 44 includes at least one support pusher member 110 perpendicular to the longitudinal direction of movement of said support.

In the embodiment shown in the figures, there is only one support pusher member.

It takes the form of a plate of generally elongate shape in a direction in a plane P 1 (FIG. 3) containing the median longitudinal axis XX' and constituting a plane of symmetry for the combination of the support 44 and the contact members 40 and 42.

Figure 4:
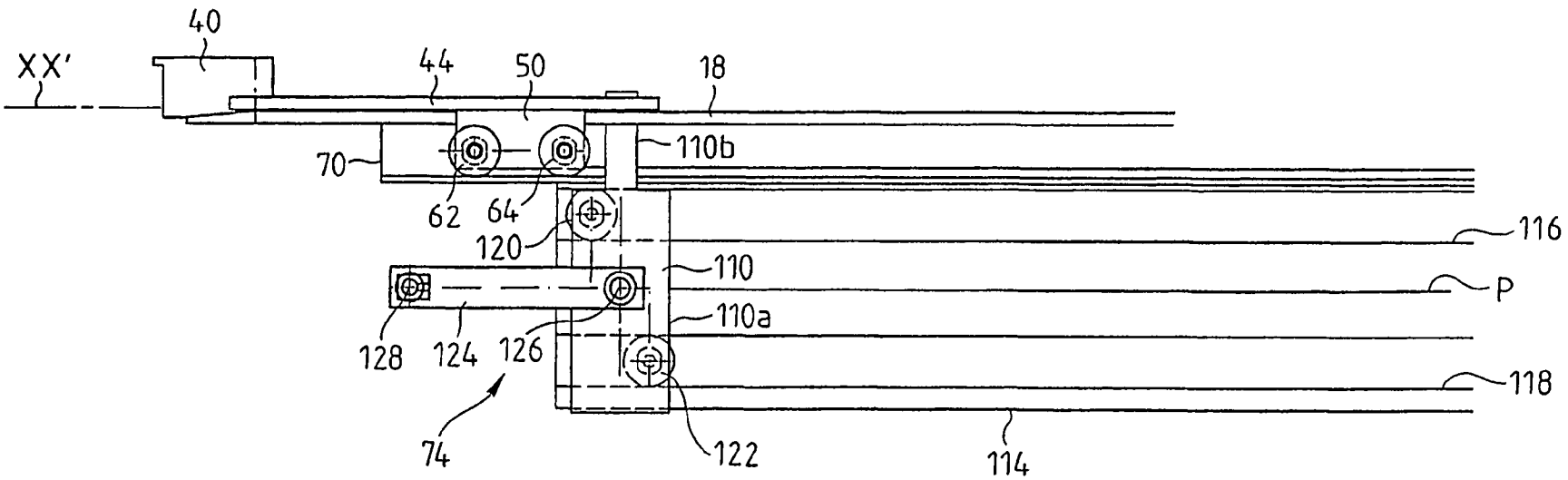
FIG. 4 is a partial diagrammatic view to a larger scale and in longitudinal section of the portion of the machine shown in FIG. 1 containing contact members and a support in the form of a carriage.

In the FIG. 4 side view, the pusher member has a general shape similar to that of a bottle, comprising a body 110*a* at the upper end of which is a reduced section area constituting a neck 110*b* that is fastened to the support 44.

The portion 110*b* forming the neck of the pusher member slides in a groove 112 in the routing table 18 (FIG. 2) when the support 44 moves.

Thus the reduced section area 110*b* is mechanically weakened and constitutes a kind of mechanical fuse that breaks if maximum mechanical forces are exerted in this area.

Accordingly, maintenance personnel need only remove and replace the pusher member, instead of removing and replacing the whole of the belt 76.

A support 114 mounted on the frame 104 helps to guide the movement of the pusher member 110 in longitudinal translation.

The longitudinal support 114 incorporates two parallel longitudinal housings located one above the other and each having an opening facing toward the pusher member 110.

The open housings 116 and 118 constitute grooves adapted to receive respective bearings 120, 122 mounted on respective hubs 125, 127 fastened to the pusher member 110.

As shown in FIG. 4, the bearings 120 and 122 are offset relative to each other in the longitudinal direction XX' to distribute the forces transmitted to the pusher member 110 and thereby to compensate a torsion force that would be exerted on that member if the bearings were disposed on the same vertical line.

Note that additional bearings could be added alongside at least one of the bearings 120, 122, preferably alongside the bearing 120, to improve the resistance of the pusher member to a torsion force.

The bearings mounted on the pusher member and respectively cooperating with the grooves 116 and 118 constitute means for holding the pusher member in a position perpendicular to the longitudinal direction of the support carriage 44.

The mechanism 74 also includes link means 124 articulated about two link shafts parallel to the shafts 78 and 80.

One shaft 126 connects the pusher member 110 to the link means 124 and remains at all times in the plane P containing the shafts 78 and 80.

The other shaft 128 is fastened to the belt 76.

In a different embodiment, the link means can be weakened instead of a portion of the pusher member 110, and constitute a mechanical fuse for the connecting mechanism 74 as a whole.

The presence of the connecting mechanism 74 reduces the mechanical forces exerted on the transport member consisting of the belt by distributing those forces, in particular in the mechanism itself.

The forces appear if the support carriage 44 with the contact members 40 and 42 has to move heavy documents and also in the event of a document jam on the routing table 18.

Because of the structure of the mechanism 74 shown in the figures, the forces that would otherwise be exerted on the belt in the absence of the mechanism, and which would therefore deform it, or even damage it, are distributed between the shafts 126 and 128, the link means 124 and the guide means for the pusher member 110.

It should be noted that in the absence of the bearings 120 and 122 that help to guide the pusher member, the mechanical forces exerted on that member would be exerted only on the link shaft 126.

Because, in the connecting mechanism 74, the link means are never perpendicular to the routing table 18 and the forces exerted by the belt 76 on the link means are only thrust or traction forces, the forces to which said belt is subjected are greatly reduced.

Because the weakened area 110*b* of the pusher member 110 is lower than a stop formed directly on the belt 76 would be, the torque transmitted to the pusher member is reduced compared to a solution with stops mounted directly on the belt.

Furthermore, in the event of a document jam, the pusher member 110 can, in some situations, be raised slightly and thereby transmit to the guide means of the support carriage some of the forces transmitted to it.

The guide means therefore also contribute to the distribution of mechanical forces as taught by the invention.

As shown in FIGS. 1, 5 and 6, the support carriage 44 with the contact members 40 and 42 moves from a rest extreme position shown in FIG. 1 to an intermediate position shown in FIG. 5 in which said contact members come into contact with the documents 34 and push them in the downstream direction toward the insertion unit 20.

FIG. 6 shows the support carriage 44 with the contact members 40 and 42 in another extreme position, in which they are virtually in contact with the table 22 of the insertion unit 20 and the contact members push the documents 34 all the way into the envelope 26.

Note that the system according to the invention consisting of contact members mounted on the support 44 and the connecting mechanism 74 with the drive means imparts to the contact members sufficient extent for them to reach the opening of the envelope 26, although the drive means are remote from the insertion unit and converts the rotation of the drive means 76, 82, 84, 88 into front to back reciprocation in translation between the extreme positions previously cited, to return the combination of the contact members and the support to the initial position shown in FIG. 1 without damaging the envelope.

Without the mechanism 74 that converts the rotation of the drive means 76 into longitudinal front to back movement, the rotation of the contact members would tear the envelope.

The invention claimed is:

1. A machine for inserting documents into an envelope, the machine including a generally elongate document routing table on the upstream side of an insertion unit for inserting said documents into an envelope, and at least one contact member that is adapted to be moved longitudinally by drive means remote from the insertion unit toward the insertion unit and is adapted to push the documents on the routing table, wherein said at least one contact member is on a mobile support connected to the drive means in an area upstream of said at least one contact member and the drive means imposing on said at least one contact member and on the mobile support a reciprocating movement in translation between two positions in one of which said at least one contact member is in the vicinity of the insertion unit, wherein the drive means include an endless loop longitudinal transport member rotatably mounted around two parallel shafts perpendicular to the longitudinal direction of the table and contained in a plane under and parallel to the routing table and the support is connected to said drive means by a connecting mechanism means for reducing the mechanical forces exerted on the transport member by distributing those forces in the mechanism, wherein the connecting mechanism means includes at least one pusher member perpendicular to the longitudinal direction of movement of the support for pushing the support and link means articulated about two link shafts that are parallel to the shafts of the transport member and one of which is fastened to the pusher member and disposed in the plane and the other of which is fastened to the transport member, wherein the connecting mechanism means includes means for holding the pusher member in a position perpendicular to the longitudinal direction of movement of the support, wherein the holding means include two bearings mounted on the pusher member, offset relative to each other in the longitudinal direction and respectively cooperating with two parallel longitudinal grooves disposed one above the other.

2. The machine according to claim 1, wherein the connecting mechanism means converts rotation of the longitudinal transport member into longitudinal reciprocation in translation.

3. The machine according to claim 1, wherein the pusher member has a reduced section area in an upper portion in which the maximum forces are exerted.

4. The machine according to claim 1, wherein the link means comprise a mechanical fuse.

5. The machine according to claim 1, further comprising guide means for guiding longitudinal movement in translation of the support.

6. The machine according to claim 5, wherein the guide means include bearings cooperating with longitudinal guide members.

7. The machine according to claim 6, wherein the longitudinal guide members are angle-irons.

8. A machine for inserting documents into an envelope, the machine including a generally elongate document routing table on the upstream side of an insertion unit for inserting said documents into an envelope, and at least one contact member that longitudinally by a drive mechanism remote from the insertion unit toward the insertion unit and is adapted to push the documents on the routing table, wherein the at least one contact member is on a mobile support connected to the drive mechanism in an area upstream of said at least one contact member and the drive mechanism imposing on said at least one contact member and on the mobile support a reciprocating movement in translation between two end positions of the reciprocating movement in one of which said at least one contact member is in the vicinity of the insertion unit, wherein, the drive mechanism includes an endless loop longitudinal transport member rotatably mounted around two parallel shafts perpendicular to the longitudinal direction of the table and contained in a plane under and parallel to the routing table; and the support is connected to said drive mechanism by a connecting mechanism, wherein, the connecting mechanism includes at least one pusher member perpendicular to the longitudinal direction of movement of the support for pushing the support; and the connecting mechanism includes at least one link articulated about two link shafts that are parallel to the shafts of the transport member and one of which is fastened to the pusher member and disposed in the plane and the other of which is fastened to the transport member, wherein, the connecting mechanism includes a holder for holding the pusher member in a position perpendicular to the longitudinal direction of movement of the support, and wherein, the holder includes two bearings mounted on the pusher member, offset relative to each other in the longitudinal direction and respectively cooperating with two parallel longitudinal grooves disposed one above the other.

* * * * *